US007344089B1

(12) United States Patent
Sutterfield

(10) Patent No.: US 7,344,089 B1
(45) Date of Patent: Mar. 18, 2008

(54) WIRELESS AIR-VOLUME DAMPER CONTROL SYSTEM

(76) Inventor: Bill R. Sutterfield, 9571 Estates Dr., Gilroy, CA (US) 95020

( * ) Notice: Subject to any disclaimer, the term of this patent is extended or adjusted under 35 U.S.C. 154(b) by 831 days.

(21) Appl. No.: 10/395,774

(22) Filed: Mar. 24, 2003

(51) Int. Cl.
*F24F 7/00* (2006.01)
*G05D 23/00* (2006.01)

(52) U.S. Cl. ..... 236/49.3; 236/51; 165/209; 165/211

(58) Field of Classification Search ..... 62/298; 236/49.3, 51; 165/217, 209, 237; 137/802
See application file for complete search history.

(56) References Cited

U.S. PATENT DOCUMENTS 3,806,027 A * 4/1974 Ginn et al. ..... 236/49.4
4,491,061 A * 1/1985 Nishizawa et al. ..... 454/229
4,824,012 A * 4/1989 Tate ..... 236/49.3
5,117,900 A 6/1992 Cox
5,271,558 A 12/1993 Hampton
5,533,668 A 7/1996 Erikson
6,250,560 B1 * 6/2001 Kline et al. ..... 236/49.3
6,364,211 B1 * 4/2002 Saleh ..... 236/49.3
2001/0048030 A1 * 12/2001 Sharood et al. ..... 236/49.3

* cited by examiner

*Primary Examiner*—ChenWen Jiang
(74) *Attorney, Agent, or Firm*—Richard Esty Peterson

(57) ABSTRACT

A wireless air-volume damper control system for regulating air balance in a ducted network, the damper control system having one damper or more damper units installable in the ducted network at locations where air flow in the terminal can be adjusted, the damper units each having a damper blade with a motor to pivot the blade, a power source for powering the motor and pivoting the blade, a receiver and electronic circuitry that operates the motor in response to signals received by the receiver with a portable remote controller having inputs controls and a transmitter that transmits signals to the receiver for operation of the damper unit and a flow volume measuring device for measuring the volume of air flowing in the terminal, the airflow being adjusted by signals from the transmitter of the remote controller in response to measurements from the flow volume measuring device.

18 Claims, 7 Drawing Sheets

WIRELESS AIR-VOLUME DAMPER CONTROL SYSTEM

BACKGROUND OF THE INVENTION

This invention relates to a wireless air-volume damper control system where it is desired to regulate air volumes in ducted air handling systems by remote adjustments of each volume control damper.

The wireless air-volume damper control system is particularly useful in testing, adjusting and balancing of ducted exhaust, heating, ventilating and air conditioning systems.

A typical system designed by a professional engineer would contain various components such as fans, coils, filters, inlets, outlets, temperature controls and air volume balancing dampers as design requirements.

One requirement, testing and balancing, requires air volume regulation to each inlet and outlet using a balancing damper, and as each change in a discrete damper affects flow in other parts of system, the balancing process is one of multiple adjustments of many volume control dampers.

Predicting how an installed ducted system is going to perform is not an exact science and the system must be balanced to achieve a desired flow at each inlet and outlet. Balancing a system requires adjustment of each damper, and as each change in a discrete damper affects flow in other parts of the ducted system, the balancing process is one of tuning, often requiring multiple adjustments of many dampers in a multiple damper system.

Adding to the difficulty of balancing flow in a ducted system in a building is the typically concealed location of the dampers within the space above ceiling in each floor of the building. Access is not only difficult, but the process of accessing a damper may result in damage to ceiling tiles or other entry parts provided for adjustment of the dampers.

Where flow volumes at building terminals are certified, special equipment is required to quantify air flow making an air balance typically a two man operation, with one man adjusting a damper and another man measuring the volume of air flowing from the affected terminal. These and other difficulties in adjusting existing damper systems make the described wireless air-volume control system advantageous.

It is a primary object of this invention to simplify the operation of balancing a ducted network having multiple terminals with multiple dampers by remote adjustment of individual dampers in the ducted system.

It is also an object of this invention to provide for remote adjustment by use of a portable wireless controller.

It is another object of this invention to freeze a balanced system to prevent unauthorized changes to the system.

It is another object of this invention to retain damper settings when power is removed from the system.

SUMMARY OF THE INVENTION

The wireless air-volume, damper control system of this invention is designed to facilitate the balancing of a ducted network having a plurality of adjustable dampers and terminals.

It is to be understood that the invented system is primarily utilized in air conditioning, heating and ventilation systems in buildings, but may be applied to building exhaust systems and other ducted networks where flow control dampers are difficult to access and adjust manually. In the description of this system the term terminal is used both for the intake and discharge vents in the interior or exterior of a structure and includes the protective grille, diffuser or register covering the vent which remain in place during the flow measuring and adjustment process.

A ducted network is typically the air duct circuit in a heating and ventilation system, which includes air conditioning or other circulation systems in buildings and structures. The term ducted network also includes formed conduits or conveying tubes designed for specialty applications where a conventional air duct system is not suitable, for example, where the conveyed gas includes corrosive or toxic substances drawn into an exhaust system for atmospheric venting. The term air-volume damper control system is used for the primary conveyance of air, but includes other gases conveyed in a ducted network regulated by flow control dampers. Suitable adjustments in the composition and operation of the controlled damper are contemplated in adapting the wireless air-volume, damper control system of this invention to harsh or extraordinary environments and do not detract from the teachings of the invention disclosure.

The wireless air-volume, damper control system of this invention combines a portable handheld remote controller that wirelessly communicates with discrete motor driven dampers to adjust the damper blade and thereby regulate the flow of the controlled gas, usually, air. Preferably, the dampers are wire connected to a reliable and accessible low voltage power source. The damper control system is advantageously designed for a plurality of dispersed dampers in a ducted network typically concealed from sight.

Access to individual dampers is therefore frequently difficult and time consuming. Until reliable battery packs are available, hard wiring at the time of installation of the damper system is preferred to eliminate later unscheduled access for battery pack change. A power source remote from the dampers has other advantages in restricting access to the control system.

In new buildings where the wireless damper control system of this invention is installed as a part of the scheduled construction, the additional hardware costs for each damper and the greater installation costs for system wiring is more than offset by the savings in facilitated testing and air balance tuning. Elimination of damage to or soiling of newly installed ceiling tiles or access portals adds to the utility of the described system.

Following system installation, a number of motor driven dampers or damper units are connected to a selectively activated power source that is conveniently located. In the described embodiment a power connector box with a jack socket is located next to a conventional 120 volt wall outlet for powering a transformer having a cable jack compatible with the jack socket. A convenient, easily interruptable power source is thereby provided for the damper system.

The number of dampers on a low voltage circuit are limited and multiple circuits, for example, one or two on each floor, can accommodate the hundreds of dampers that may be required in a modern multi-story building. Each damper in the entire damper system has an individual code key or I.D. to enable the portable controller to discretely access a specific damper and adjust the damper blade to regulate air flow. Electronic measurement of air flow at a particular terminal or vent is conveniently accomplished by a portable flow measuring device having a hood or cowling placeable over the vent. Having a device to remotely adjust a particular damper affecting the air flow at the vent being examined greatly facilitates the initial testing and tuning of the system. The ability of an individual operator to accomplish the task of monitoring air flow while adjusting the damper in real time clearly shortens the time to complete a successful and certifiable air balance.

The portable, handheld remote controller provides a wireless manner of communicating with an individual remote damper. In its basic form the remote controller includes a casing with a battery pack, an on-off key with a light indicator, a set of code switches to identify and select a particular damper, and a pair of directional switches, one to open the damper and the other to close the damper. Internally the controller has a transmitter to communicate with the receiver on the identified damper and pass a control signal to operate a drive motor connected to the internal blade of the damper and remotely open or close the damper.

For the convenience of the operator testing the flow at a terminal, the flow measuring device includes a handle having a rocker switch for controlling the opening, and closing of the volume control damper being adjusted. A removable cable with end jacks interconnects the flow measuring device and remote controller when this convenient feature is used. In addition, when direct operation of a damper is required, a hand control box with a cable and plug can be directly plugged into a socket on the damper for opening and closing the damper blade using a pair of control switches on the hand control box.

Other features include an audible feedback signal provided to indicate the blade is in the fully open or closed position; a worm gear braking drive for the blade provided to hold the blade position when the power is cut to the drive motor on reaching a blade limit position; and, a means of removing the supply of power on completion of a damper balancing session. This last feature prevents unauthorized tampering with one or more dampers for a local climate change that may throw the remaining system out of balance. These and other features of this invention will become apparent on a consideration of the detailed description of the preferred embodiments.

DETAILED DESCRIPTION OF THE PREFERRED EMBODIMENT

Figure 1:
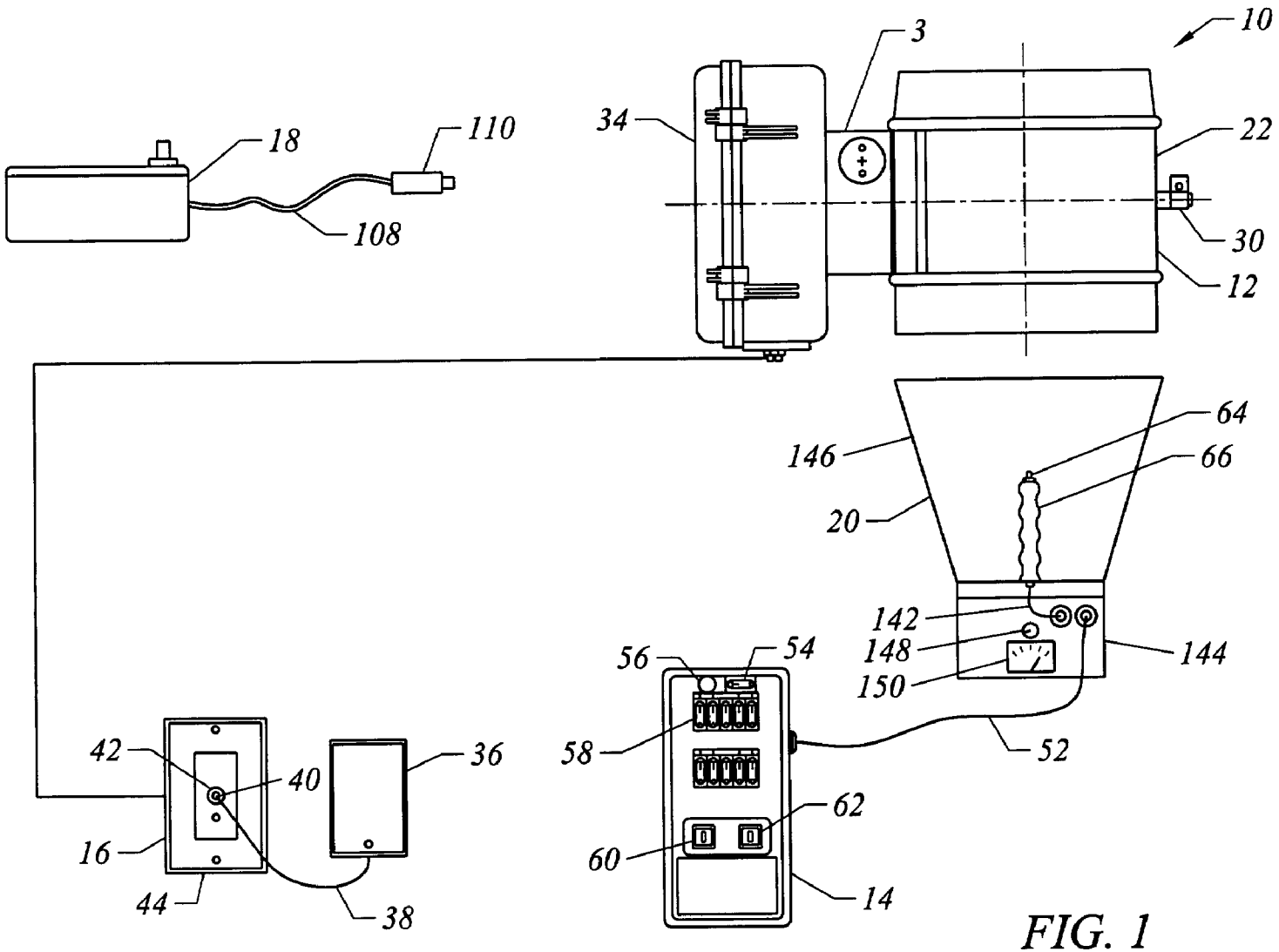
FIG. 1 is a schematic illustration of the wireless air-volume damper control system with all accessories and a single representative damper unit.

The wireless air-volume damper control system is shown in FIG. 1 as an assemblage of components and is designated generally by the reference numeral 10. Included in the wireless damper control system 10 is at least one damper unit 12, a handheld remote controller 14, a low voltage power supply 16 that connects to the damper unit 12 for powering adjustments to the unit, and an auxiliary hand control box 18 for direct connection and adjustment of the damper unit 12. In the preferred embodiment a flow measuring device 20 is part of the damper control system, however, other means may be employed for measuring the volume of air flow in an air balancing process, which is the primary use of the described system.

Figure 2:
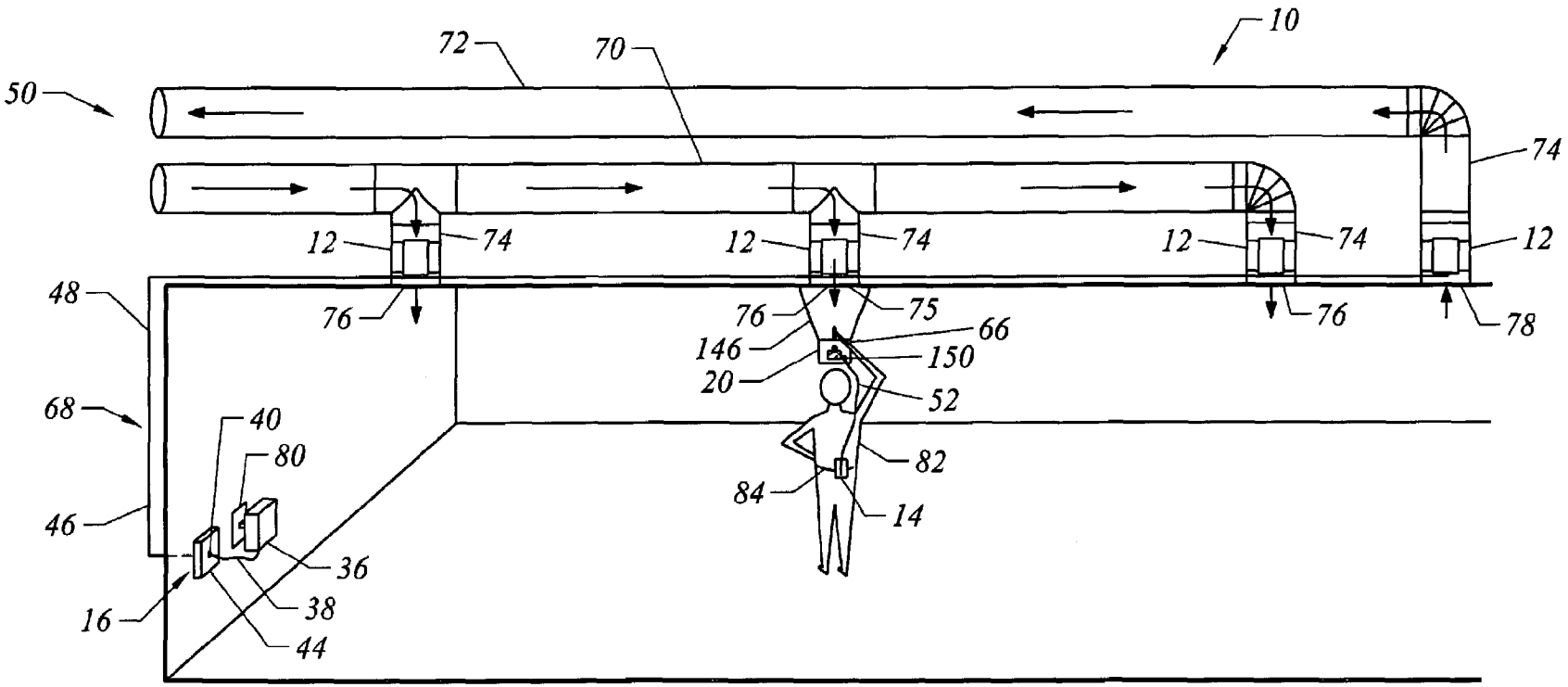
FIG. 2 is a schematic illustration of an installed damper control system with multiple damper units
Figure 3:
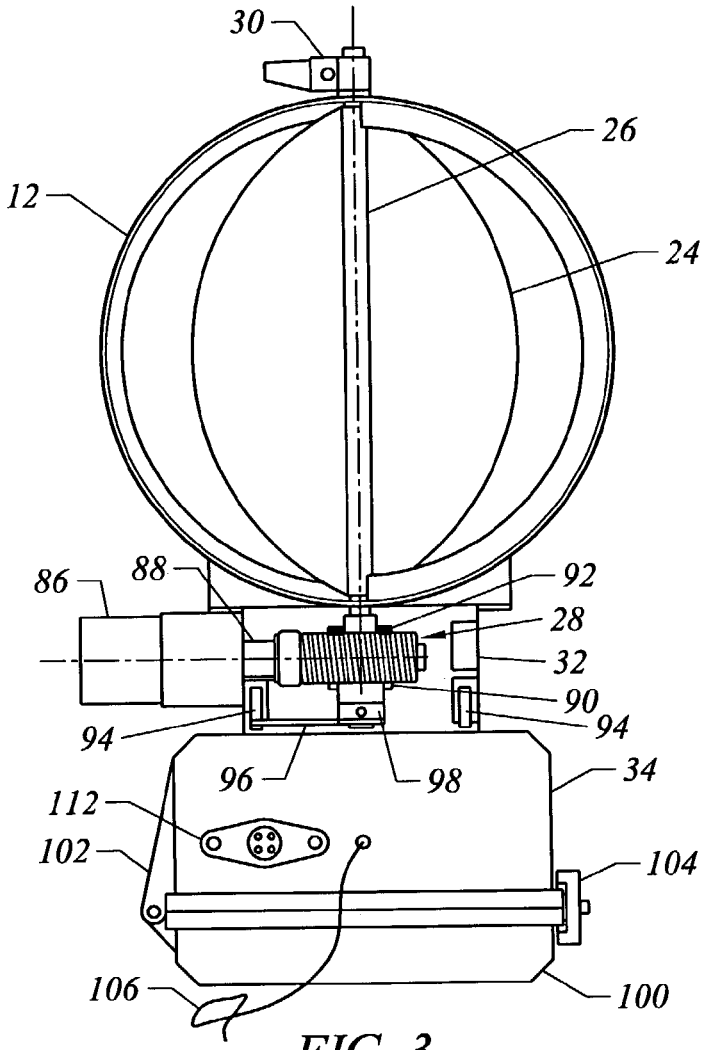
FIG. 3 is a side elevational view of the representative damper unit showing the worm gear drive assembly and the connected damper blade.

In the wireless air-volume damper control system of FIG. 1, the motor driven damper unit 12, shown in greater detail in FIGS. 2 and 3, has a duct housing 22 with a flow control mechanism 23 including a pivotally adjustable damper blade 24 having a pivot shaft 26 connected to a drive mechanism 28. The pivot shaft 26 has an indicator flag 30 that provides an external visual indication of the position of the damper blade 24 within the housing 22. The drive mechanism 28 is mounted to an interconnecting bracket structure 32 that interconnects the conduit housing 22 with a receiver box 34 which contains the electronics for remote controlling and operating the drive mechanism 28 for adjusting the damper blade 24 in the damper unit 12.

As shown in FIG. 1, the low voltage power supply 16 includes a wall transformer 36 which can be plugged into any AC 120 volt outlet for transforming the 120 AC voltage to a 12 volt DC supply in a power cable 38 and jack 40 that plugs into a socket 42 in a power connector box 44. A low voltage power supply line 46 extends from the conveniently located power connector box 44 to the receiver box 34 of the damper unit. The low voltage wall transformer is sized to accommodate up to 100 damper units that are interconnected in series. An example of a simple low voltage power supply network 48 is shown in FIG. 2 for a simple conduit network 50 having four damper units.

In the damper control system of FIG. 1, the handheld remote controller of 14 is shown with a jack cable 52 that inter connects the handheld remote controller of 14 with the flow measuring device 20. The handheld remote controller, shown in greater detail in FIG. 6, has input controls 53 including a rocker switch 54 with an accompanying indicator light 56 for indicating whether the battery powered controller is on or off. In addition, the handheld remote controller 14 includes a series of ten rocker switches 58 for coding in the ID of the damper unit that is remote controlled by the controller. Control buttons 60 and 62 are operated to respectively close and/or open the damper blade 24 of the damper unit 12 remotely. It is understood that the jack cable 52 is only employed for the convenience of the operator and transfers the control button operation from the handheld controller to a rocker switch 64 a support handle of the flow measuring device 20.

Referring to FIG. 2, the wireless damper control system 10 is schematically shown installed in a building structure 68. The simple ducted network 50 includes a supply air duct 70 and a return air duct 72. It is understood that the supply and return air ducts 70 and 72 are part of a ducted network that connects to a central air system (not shown) that may heat, cool or simply cycle and circulate air throughout the building structure 68. In the schematic illustration of FIG. 2, the supply air duct 70 includes three terminal discharge ducts 74 or terminals 75, that terminate at ceiling diffuser vents 76. A balancing damper unit is installed in each terminal 775 to regulate the volume of air flow in the terminal 75.

In the ducted network 50 of FIG. 2, the return air duct 72 has an intake duct 74 connected to a damper unit 12 at a ceiling intake vent 78. Typically, the vents 76 and 78 are similar in appearance and function and are generally defined as part of the terminal 75 or simply, the terminal 75. Each damper unit 12 is powered by a low voltage power supply 16, which in the preferred embodiment, comprises the AC/DC wall transformer 36 that is plugged into a conventional wall outlet 80 for supply of low voltage power through the cable 38 that connects to a low voltage power line 46 at a power connector box 44. In the system of FIG. 2, the four damper units 12 connected in series by the low voltage supply circuit 48.

In the schematic illustration of FIG. 2, a testing operator is shown holding a flow measuring device 20 against a vent 76 allowing the air flow through the vent to be measured. The operator 82 is wearing the handheld remote controller 14 on a belt 84. The remote controller 14 is connected by the jack cable 52 to the flow measuring device 20 to allow the operator to adjust the proximate damper unit 12 by the handle controls as previously described. In this manner, a single operator can quickly measure air flow at each of the vents 76 and 78 and simultaneously adjust the associated damper unit 12 to balance the air flow system. As noted, this may require one or more measurements and adjustments at each vent since change in a damper unit setting may affect previously adjusted dampers requiring resetting. Once the damper units 12, in the terminals 75 of the conduit network 50 are properly adjusted, the wall transformer 36 and jack 40 at the end of cable 38 are removed thereby interrupting the power supply to prevent unauthorized tampering with the balanced air system after adjustment is completed.

Referring now to the enlarged view of the damper unit 12 of FIG. 3, the drive mechanism 28 is shown to include a gear motor 86 having a drive shaft 88 on which is mounted a worm gear 90. The worm gear 90 engages a complimentary concentric gear 92 on the pivot shaft 26 of the damper blade 24. Use of the worm gear 92 provides for self braking and is a preferred means for maintenance of the position of the damper blade 24 when the motor 86 is deactivated by interrupting the power supply 16. To limit the rotation of the damper blade 24, a pair of limit switches 94 are mounted to the bracket structure 32 and are selectively activated by a lever 96 projecting from an end fitting 98 on the pivot shaft 26.

Figure 4:
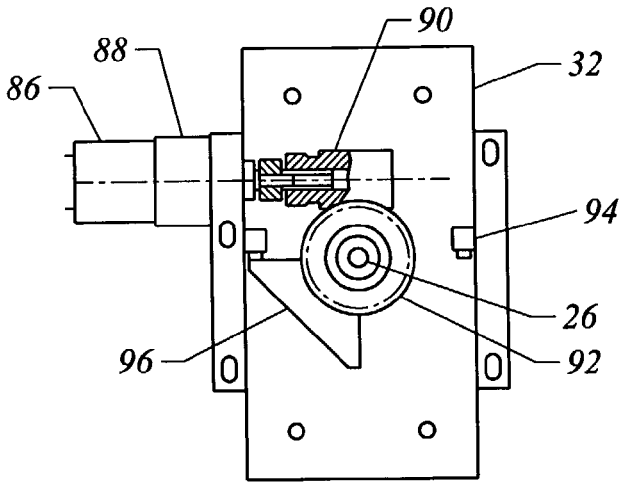
FIG. 4 is a partial cross sectional view of the damper unit of FIG. 3 with the limit switch mechanism.
Figure 7:
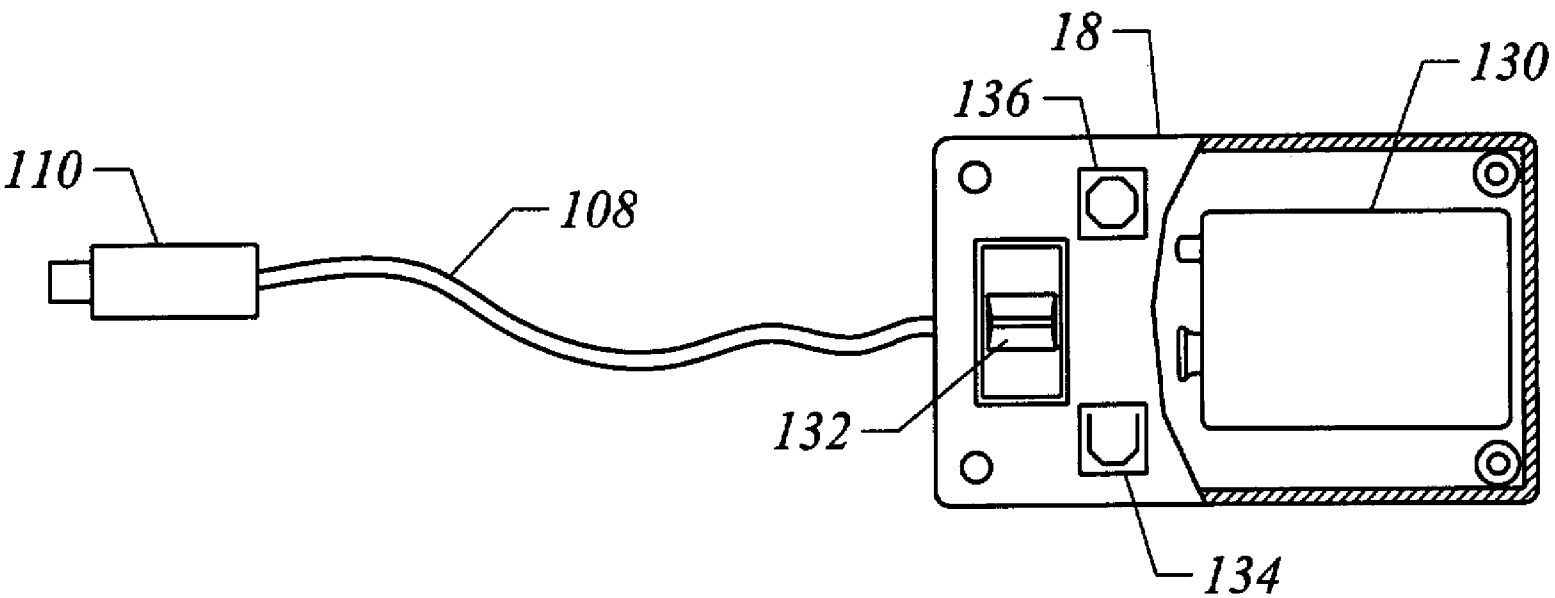
FIG. 7 is a perspective view of the alternate hand control box for directly adjusting a damper unit.

The lever 96 as shown in FIG. 4, is fan-shaped and can selectively activate a limit switch on the 90 degree travel of the damper blade 24 from a fully closed to a fully opened position. The bracket structure 32 is mounted on the receiver box 34 which includes a door 100 with a hinge 102 and latch 104. Projecting from the receiver box 34 is an antenna 106 for receiving radio frequency identity code and control signals from the remote controller 14. As noted, direct control of the motor 86 is provided by use of the hand control box 18, which is shown in FIG. 7. The hand control box 18 includes a cable 108 and jack 110 that plugs directly into the jack socket 112 on the side of the receiver box 34 of FIG. 3.

Figure 5:
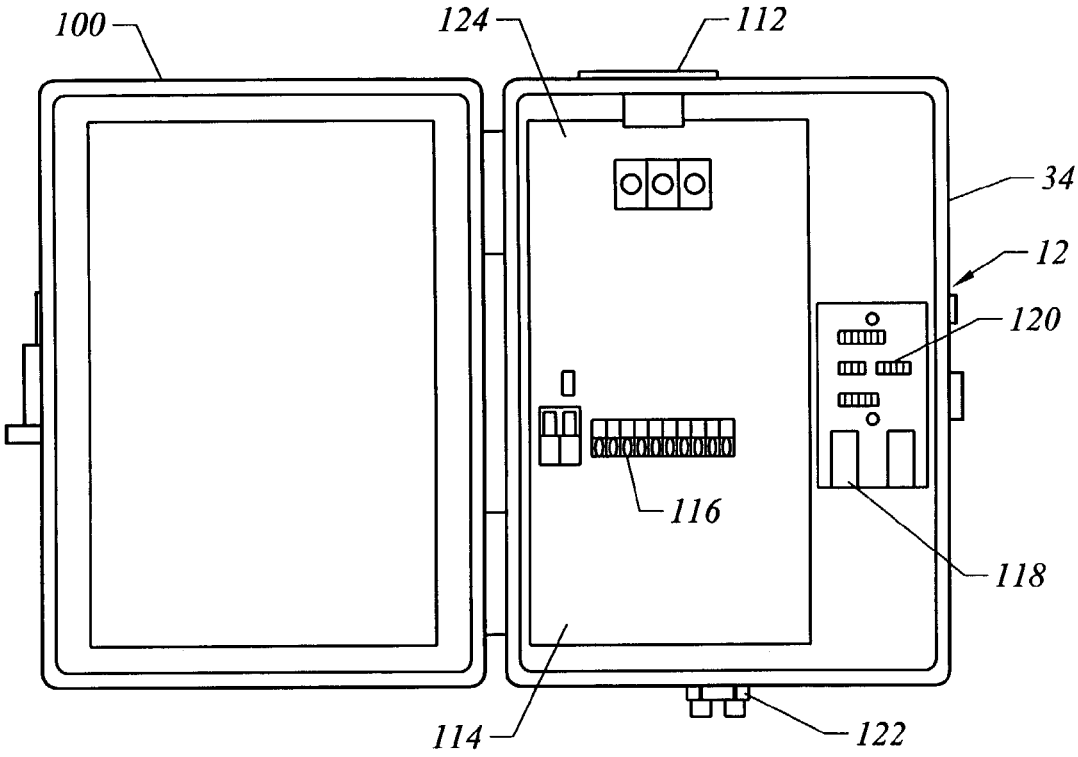
FIG. 5 is a bottom view of a receiver box in the damper unit with box door opened to show the switch panel.

Referring now to FIG. 5, the receiver box 34 is shown with the door 100 opened to reveal a panel 114 having a set of codes switches 116 that are set to identify this damper unit 12 from others in the damper control system 10. In addition to the code switches 116, the receiver box 34 includes a relay 118 and internal circuit connectors 120 for operating the gear motor 86. An external power connector 122 provides for convenient connection of a compatible connector in the low voltage supply circuit 48. The integrated electronics of the receiver unit 124 are contained under the panel 114 and are provided as a conventional component by a supplier. Once coded the damper unit 12 will respond only to a signal from a remote controller that is addressed to the matching damper unit.

Figure 6A:
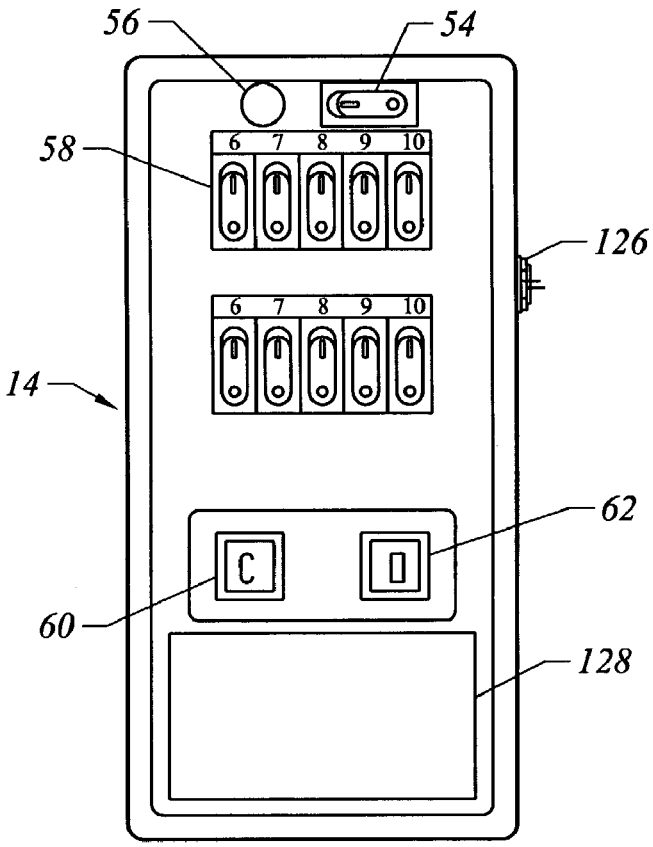
FIG. 6A is a front view of the wireless remote controller for remotely adjusting a damper unit.
Figure 6B:
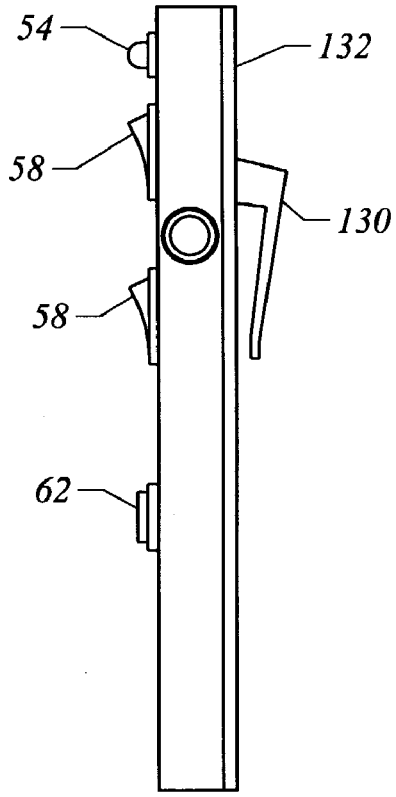
FIG. 6B is side view of the remote controller of FIG. 6A.

Referring to FIGS. 6A and 6B, the handheld remote controller 14 is shown with the previously described on/off rocker switch 54 and indicator light 56, code switches 58 and control buttons 60 and 62. The control buttons 60 and 62 are marked with a "C" for close and "O" for open, respectively.

The remote controller 14 has a jack connector 126 for the jack cable 52 when used in conjunction with the flow measuring device 20 as shown in FIG. 1. A panel cover 128 provides for access to a 9 volt battery (not shown) for powering the remote controller 14. For the convenience of the operator, the remote controller includes a belt clip 130 on the back 132 of the remote controller 14 for convenient attachment of the remote controller to the belt in 84 of an operator 82, as shown in FIG. 2.

In FIG. 7, the hand control box 18 is shown and includes the cable 108 and jack 110 for connecting the hand control box directly to the damper unit 12 as previously described. The box is shown partially in cross section to reveal the internal 9 volt battery 130 of the type preferred for use in the remote controller 14. The hand control box 18 includes an on-off switch 132 and controller buttons 134 and 136 for closing and opening the damper blade when the control box 18 is connected to a damper unit 12.

Figure 8:
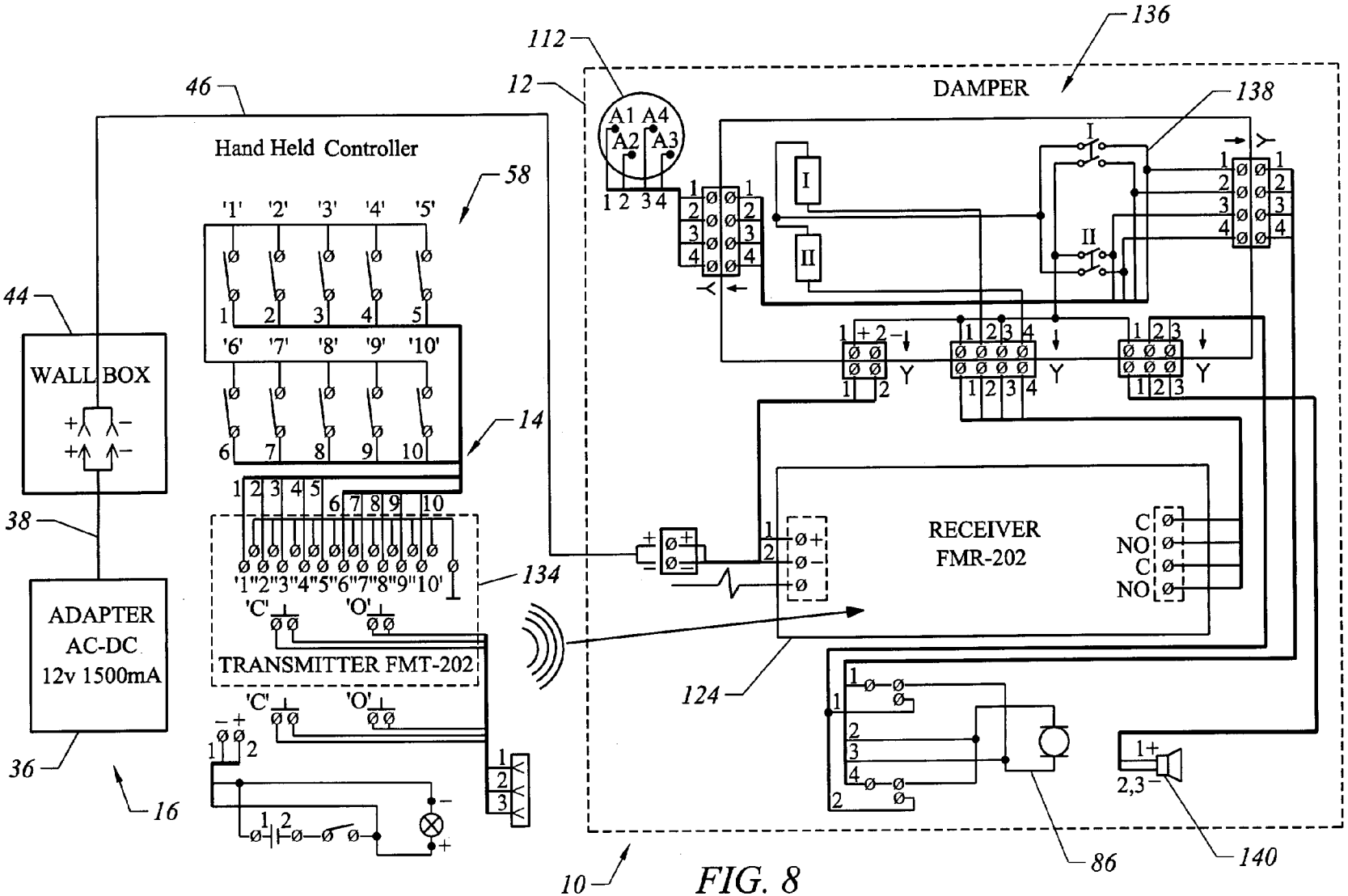
FIG. 8 is a general schematic diagram of the wireless damper control system.

Referring now to FIG. 8, the general circuit diagram for the wireless damper system 10 is shown. The wall transformer 36 is plugged into a conventional wall outlet and provides power to the power connector box 44 by cable 38. The low voltage power line 46 connects the power supply 16 to a damper unit 12. The damper unit 12 has an internal electronic circuit 136 for operating the damper unit 12 under direction of the receiver unit 124 as controlled by the remote controller 14. As noted, a portable hand control box 18, shown in FIG. 7 may be connected to the damper unit 12 at jack socket 112 for direct control of the damper blade through internal switch circuit 138. In the diagrammatic illustration shown in FIG. 8, the handheld remote controller 14 is illustrated transmitting a signal from the internal transmitter unit 134 to the receiver unit 124 of the damper unit 12 identified by the settings of the manual rocker switches 58 of the input controls 53. The damper blade 24 of the selected damper unit is opened or closed as desired by the operator 82. When the damper blade 24 reaches the fully open or fully closed position, the lever 96 contacts a switch 94, cuts power to the gear motor 86 and creates an audible signal at sound generator 140.

In an air balancing operation using the preferred air flow measuring device 20, the jack cable 52 is connected to the handheld remote controller 14 and to the flow measuring device 20 as shown in FIG. 1. A short jack cable 142 connects the extended handle 66 to an internal circuit (not shown) in the base portion 144 of the flow measuring device 20 allowing the rocker switch 64 at the end of the handle 66 to control the balancing damper for the inlet or outlet being tested. During the test, the hood portion 146 of the flow measuring device 20 is held up against a terminal 75, such as the supply vent 76 as schematically illustrated in FIG. 2.

The flow measuring device 20 has a step switch 148 and meter 150 to provide the operator with a real-time measure of the volume of air flow. While viewing the meter 150 the operator adjusts the target damper unit 12 until the desired flow volume is achieved. The operator continues to test the terminals 75 and adjust the associated air balance damper unit 12 until the system is performing as desired. As noted, this process may require testing and adjusting the same terminal and damper unit more than a single time to assure compliance with a desired result.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

The invention claimed is:

1. In a ducted gas flow system having a network of ducts with code key terminals and balancing dampers in the terminals, the improvement comprising a wireless damper control system having:

a plurality of motor driven damper units having a duct housing with a flow volume control mechanism, each of the damper units being installable in a terminal of the ducted network for control of the volume of gas flow in the terminal, the damper unit having in addition, a drive motor with a drive mechanism connecting the drive motor to the flow control mechanism, a receiver unit, an electronic circuit that operates the damper unit under direction of the receiver unit, and a power source powering the drive motor and receiver unit;

a portable remote controller having a power source, input controls that select one of the plurality of damper units in the ducted gas flow system and input controls that operate the flow volume control mechanism of the selected damper unit to regulate the volume of gas flow in the terminal of the selected damper unit, wherein the volume of gas flow in each terminal is adjusted for a desired balance of gas flow in the ducted gas flow system by select adjustment of the volume control mechanism of each damper unit, and wherein the adjusted volume control mechanism of each damper unit is maintained in position after adjustment and balance of the system; and, a control box electronically connectable to a selected damper unit wherein the control box enables the flow volume control mechanism to be operated.

2. The wireless damper control system in the ducted gas flow system of claim 1, wherein the power source powering the drive motor and receiver unit of each damper unit is a common low voltage power supply, supplying low voltage power to each damper unit.

3. The wireless damper control system in the ducted gas flow system of claim 2, wherein the power supply is interruptable and the position of the volume control mechanism is maintained when power is interrupted.

4. The wireless damper control system in the ducted gas flow system of claim 3, wherein the low voltage power supply includes a transformer pluggable into a conventional wall socket, a low voltage supply circuit connected to each damper unit, and a power cable connecting the transformer and low voltage supply circuit.

5. The wireless damper control system in the ducted gas flow system of claim 4, wherein the low voltage supply circuit includes a power connector box with a socket and the power cable has a jack that plugs into the socket for powering the damper units during an air balance procedure.

6. The wireless damper control system in the ducted gas flow system of claim 1, in combination with a flow measuring device for measuring gas flow in the terminals.

7. The wireless damper control system in the ducted gas flow system of claim 6 wherein the flow volume measuring device includes a display of measurements observable by an operator.

8. The wireless damper control system in the ducted gas flow system of claim 6 wherein the system includes operator controlled switch means for remotely controlling the flow volume control mechanism mounted on the flow volume measuring device.

9. The wireless damper control system in the ducted gas flow system of claim 8 wherein the flow volume measuring device has a handle and wherein the operator controlled switch means is a rocker switch on the handle of the flow volume measuring device.

10. The wireless damper control system in the ducted gas flow system of claim 1, the control box having a cable wherein each damper unit has a switch circuit and the control box cable connects to the switch circuit for direct operation of the flow volume control mechanism using the control box.

11. The wireless damper control system of claim 1 wherein each damper unit is coded with an ID code wherein the damper control system has a code input control device that enables each damper unit to be coded with a discrete ID code.

12. The wireless damper control system of claim 11 wherein the damper unit is at least in part coded with an ID code using the portable remote controller.

13. The wireless damper control system in the ducted gas flow system of claim 1 wherein the drive mechanism connecting the drive motor to the adjustable position flow control mechanism includes a worm gear.

14. The wireless damper control system in the ducted gas flow system of claim 13 wherein the adjustable position flow control mechanism includes a damper blade, adjustable in position between an open position and a closed position.

15. The wireless damper control system in the ducted gas flow system of claim 14 wherein the worm gear maintains the position of the damper blade when the motor is not operating.

16. The wireless damper control system in the ducted gas flow system of claim 14 wherein the damper units each have an audible alarm signal indicating when the damper blade is in the fully open and fully closed position.

17. The wireless damper control system in the ducted gas flow system of claim 14 wherein the damper blade has a flag projecting from the duct housing for externally visualizing the position of the damper blade.

18. In a ducted gas flow system having a network of ducts with code key terminals and balancing dampers in the terminals, the improvement comprising a wireless damper control system having:

a plurality of motor driven damper units having a duct housing with a flow volume control mechanism, each of the damper units being installable in a terminal of the ducted network for control of the volume of gas flow in the terminal, the damper unit having in addition, a drive motor with a drive mechanism connecting the drive motor to the flow control mechanism, a receiver unit, an electronic circuit that operates the damper unit under direction of the receiver unit, and a power source powering the drive motor and receiver unit, and a portable remote controller having a power source, input controls that select one of the plurality of damper units in the ducted gas flow system and input controls that operate the flow volume control mechanism of the selected damper unit to regulate the volume of gas flow in the terminal of the selected damper unit, wherein the volume of gas flow in each terminal is adjusted for a desired balance of gas flow in the ducted gas flow system by select adjustment of the volume control mechanism of each damper unit, and wherein the adjusted volume control mechanism of each damper unit is maintained in position after adjustment and balance of the system; and, the wireless damper control system in combination with a portable control box having a cable wherein each damper unit has a switch circuit and the control box cable connects to the switch circuit for direct operation of the flow volume control mechanism using the control box.

* * * * *